US007512999B2

(12) United States Patent
Caon

(10) Patent No.: US 7,512,999 B2
(45) Date of Patent: Apr. 7, 2009

(54) BED SURFACE WITH IMPROVED STRUCTURE

(75) Inventor: Manuele Caon, Manzano-Udine (IT)

(73) Assignee: Esperides S.r.l., Pavia Di Udine (IT)

( * ) Notice: Subject to any disclaimer, the term of this patent is extended or adjusted under 35 U.S.C. 154(b) by 141 days.

(21) Appl. No.: 10/563,016

(22) PCT Filed: Jul. 9, 2004

(86) PCT No.: PCT/EP2004/007628

§ 371 (c)(1),
(2), (4) Date: May 19, 2006

(87) PCT Pub. No.: WO2005/004676

PCT Pub. Date: Jan. 20, 2005

(65) Prior Publication Data

US 2006/0230531 A1 Oct. 19, 2006

(30) Foreign Application Priority Data

Jul. 10, 2003 (IT) ..... VI2003A0135

(51) Int. Cl.
*A47C 23/06* (2006.01)

(52) U.S. Cl. ..... 5/243; 5/241

(58) Field of Classification Search ..... 5/243, 5/241, 239, 238, 236.1, 613
See application file for complete search history.

(56) References Cited

U.S. PATENT DOCUMENTS 3,656,190 A * 4/1972 Regan et al. ..... 5/613
3,717,376 A * 2/1973 Lutchansky ..... 297/284.1
5,058,224 A 10/1991 Crosby
2006/0230531 A1 * 10/2006 Caon ..... 5/241

FOREIGN PATENT DOCUMENTS

| | | | |
|---|---|---|---|
| AT | 400 662 B | | 2/1996 |
| CH | 663 339 A | | 12/1987 |
| DE | 3844622 A1 | * | 3/1990 |
| EP | 0 749 712 A | | 12/1996 |
| WO | WO 85/02987 A | | 7/1985 |

OTHER PUBLICATIONS

International Search Report, Jul. 10, 2004.

* cited by examiner

*Primary Examiner*—Robert G Santos
(74) *Attorney, Agent, or Firm*—James V. Costigan; Hedman & Costigan, P.C.

(57) ABSTRACT

A bed plane with improved structure, comprising a plurality of slats, arranged transversally to the frame (10) of the bed and connected to it through slat-holders, includes a series of stems or pistons (11), each connected with one or more of the aforementioned slats and associated with a respective spring (12) for vertical sliding; each piston carries a pulley or sliding guide (15) for the transmission of motion, which occurs thanks to flexible members (16), such as cords, belts, chains and cables, fixed to the frame (10) of the bed plane. The pistons (11), connected to the slats, react to the pressures exerted by the body lying down on the bed plane, compensating for the sinking created by the heaviest parts of the body, i.e. those parts between the shoulders and the pelvis, with an upward thrust, supporting the lighter parts, in other words the back and kidneys.

16 Claims, 2 Drawing Sheets

BED SURFACE WITH IMPROVED STRUCTURE

The present invention refers to a bed plane with improved structure.

The rhythm of our way of life, working whilst seated and the increasingly frequent lack of physical exercise lead us increasingly towards a new concept of comfort, determined by new habits and requirements.

Considering this, the bed, the place where we spend around one third of our lives, occupies a particularly important space and constitutes the object of modern health research.

The upright position that sets apart the human race has ensured that, during the course of evolution, the spinal column takes up a particular S-configuration; such a configuration, optimal for movement in upright position, is nevertheless particularly vulnerable to painful pathologies, such as dorsalgia, back ache, lumbar and cervical arthrosis, slipped discs, etc.

To avoid encouraging such pathologies it is essential to have bed planes that allow the spinal column to keep the same position when lying down as when it is in upright position.

Indeed, an incorrect rest position prevents total muscle relaxation delaying or preventing the deepest phases of sleep (REM) from being reached, which are necessary for regenerating our psych-physical balance and, therefore, our health.

Variable and individual factors, such as body shape and the positions assumed during rest, are the main elements to be considered in realising the optimal bed system, which evolves the quality of sleep and, consequently, the quality of life.

The purpose of the present invention is, therefore, that of realising a bed plane with improved structure, which allows orthopaedically correct support of the spinal column to be obtained, with the further possibility of obtaining an active reaction of the bed plane to the anatomy of the body lying down.

Another purpose of the present invention is that of realising a bed plane with improved structure, in which aesthetic considerations are integrated with a system ideal for sleep, capable of ensuring total and physiologically healthy rest in all aspects.

Another purpose of the present invention is that of indicating a bed plane with improved structure, which allows personalised resting solutions to be obtained, capable of individually solving the problems connected with getting a good nights sleep.

A further purpose of the present invention is that of indicating a bed plane with improved structure, which, in relation to the different areas of pressure that our body exerts on the mattress according to purely individual variables, always ensures a correct posture, designing tailored sleep for each user.

The last but not least purpose of the present invention is that of realising a bed plane with improved structure that is easy and cost-effective to make, without using complex technologies or expensive components.

These and other purposes are accomplished, within the scope of the present invention, by realising a bed plane with improved structure, according to claim 1, to which we refer for the sake of brevity.

Advantageously, the bed plane according to the present invention ensures quality of rest for all body shapes (tall, short, obese, thin, etc.), weights and individual needs, based upon the different positions assumed during sleep (mainly prone, on one's back and on one's side), which determine infinite distributions of the weight of the body lying down.

The support structure of the bed plane, indeed, allows the transversal slats to actively react to the weight exerted by the different anatomical areas of the body lying down, with an upward thrust of equal intensity, equally distributed over the entire length of the bed plane, and thus ensures total comfort for any person, since it constitutes an orthopaedically correct support for the spinal column, ensuring the relaxation of the muscular system, the maintenance of a suitable body temperature and the hygienic conditions that protect against mites, bacteria, mould and dust.

The bed plane can be available both in fixed and articulated form, adjustable manually or else with a motor (even with a remote control), so as to constitute the ideal solution for sleeping, but also for relaxing and reading, thanks to the possibility of adjusting the inclination of the plane according to one's own needs. The flexible slats respond elastically to the stresses of the body lying down, yielding only where necessary, preventing sinking of the body and thus allowing the spinal column to assume a physiologically correct position, the muscle system to relax and the mattress to transpire to allow sleep always in perfect hygiene conditions and in an ideal microclimate.

Basically, the bed plane adjusts on the body, independently of the weight and the positions assumed in sleep, giving and intense feeling of well-being, similar to the total relaxation obtained when floating on water; moreover, in the case in which the slats are not contained in a perimetric frame, they are equally flexible both at the centre and at the ends, guaranteeing substantial comfort for the user.

The characteristics and advantages of a support structure for bed planes according to the present invention shall become clearer from the following description, given as an example and not limiting purposes, referring to the attached schematic drawings, in which.

Figure 1:
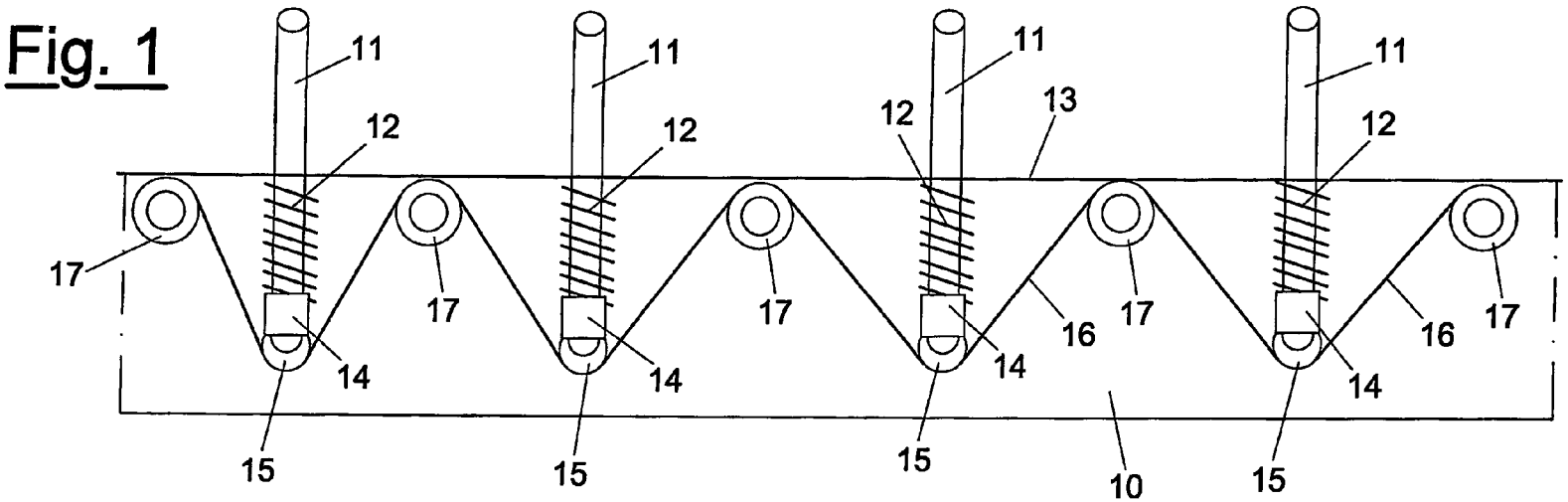
FIG. 1 is a schematic side view of a portion of bed plane with improved structure, according to the invention, in rest conditions.

The structure of the bed plane, object of the present invention, comprises a frame, generically indicated with 10 in the figures and consisting of a central bearing body, from which a plurality of stems or pistons 11 project, at the top end of which the slats are connected, through balancing joints, said slats being arranged transversally to the plane, which usually constitute the support for the mattress.

Alternatively, the top ends of the stems 11 are connected to a support beam, in turn connected, again through balancing joints, to a pair of flexible slats. Each stem 11 has a vertical excursion, which allows the bed plane to adapt to the anatomy of the body, receiving the heaviest and bulkiest zones, such as the shoulders and pelvis and energetically propping up those that require greater support, such as the lumbar zone, independently of the weight and configuration of the person who lies down there; this happens by exploiting the principle of equalisation of pressures, so that the lowering of one or more slats or portions thereof corresponds to the raising of other slats of the plane.

Thus, bed plane and mattress actively interact with each other, adapting to each other and ensuring the full achievement of the predetermined purposes.

As already stated earlier, the bed plane of the invention can foresee the use of two different types of frame 10: a perimetric frame 10, in which the slats are contained inside the frame 10 itself, or else a frame 10 constructed in an underlying position, in which the slats define the perimeter of the bed plane and the aforementioned frame 10 is smaller in size than the slats.

With reference to the aforementioned figures, it should be noted how each stem or piston 11 is associated with a respective spring (or other elastic and yielding element) 12, arranged between the top end 13 of the frame 10 and a small support block 14 of a respective pulley or sliding guide 15 for the transmission of motion.

Each pulley or sliding guide 15 is used to transmit rotary motion by means of flexible members, generically indicated with 16 in the figures, such as belts, cords, chains or cables, fixed to the frame 10.

Further pulleys or sliding guides for the transmission of motion are indicated with 17, each of which is fixed to the top end 13 of the frame 10 and arranged, at a predetermined distance, between one stem 11 and the next.

It should be specified that the stems or pistons 11 can be connected together in one, two or more rows, arranged laterally or else centrally to the frame 10 of the bed plane, whereas the slats are aligned and are slidably fixed to the ends of the bed plane, through per se known devices.

Moreover, the stems 11 can be arranged exclusively in one portion of the frame 10, for example in a central portion of the bed plane, corresponding to a region of the mattress that supports the spinal column, where, in prone position, on one's back or on one's side, the parts of the body between the shoulders and the pelvis are usually rested.

Figure 2:
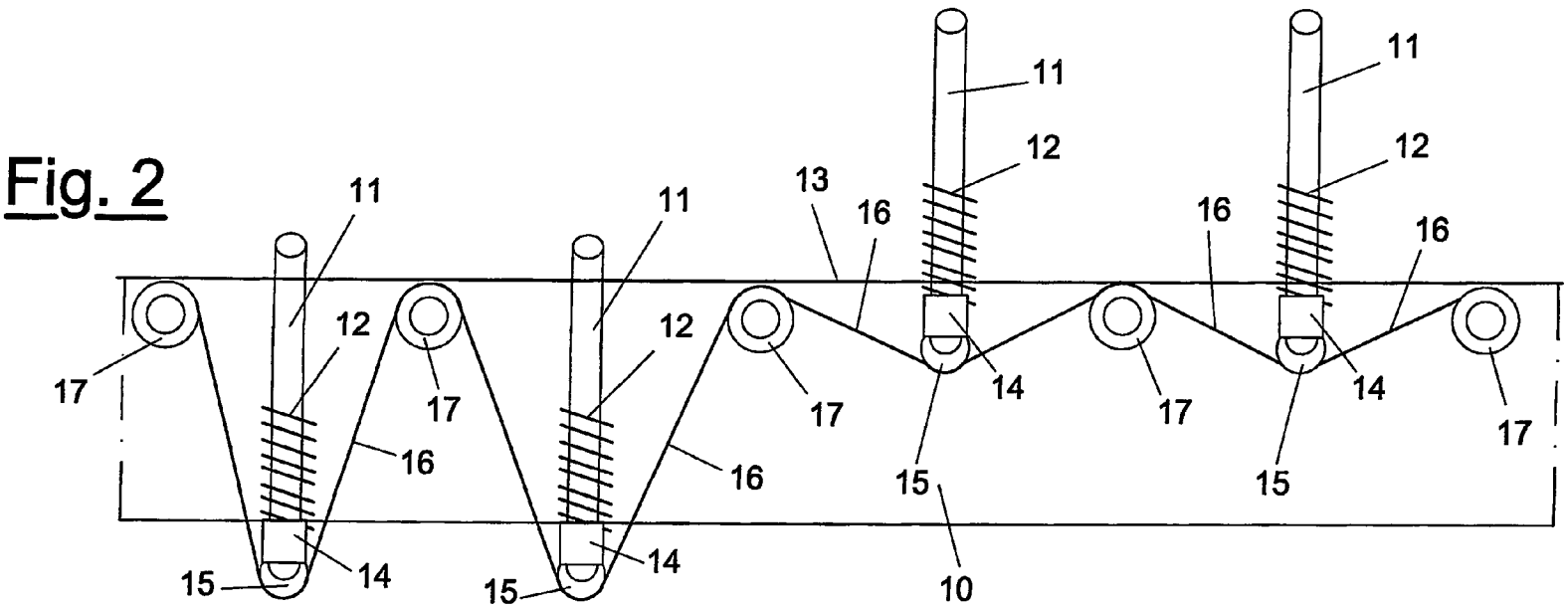
FIG. 2 is a schematic side view of a portion of bed plane with improved structure, according to the invention, in stress conditions of the bed plane following a body lying down.

From a comparison between FIGS. 1 and 2 it is clear that, by exploiting the well known principles of communicating vessels and of equalisation of pressures, the stems 11 react to the pressures exerted by the body lying down by compensating for the sinking of the bed plane, created by the heaviest parts of the body, with an upward thrust supporting the lighter parts.

Indeed, by making a certain number of stems 11 corresponding to a portion of the bed plane go back in, an outward thrust of the other stems 11 will necessarily be created, thanks to the transmission of motion determined by the belt 16 and by the pulleys or sliding guides 15 and 17 and thanks to the compression motion of the springs 12 of the stems 11 that come out from the frame 10.

The same thing happens, in the same way and in any form of combination, making the stems 11 that were previously raised go back in, thanks to the stretching motion of the springs 12, so as to obtain, correspondingly, the outward movement of respective other stems 11 in the other zones of the bed plane.

This allows absolute adaptability to the anatomy and to the configuration of the spinal column, since the structure allows the heaviest and bulkiest parts, such as the shoulders and the pelvis, to be received, and allows the spine to maintain its most natural position also when lying down, independently of the weight of the body lying upon it and the rest position; all of this is obtained, moreover, through a mechanical system that is extremely simple and substantially cost-effective, as well as safe, practical and reliable.

Figure 3:
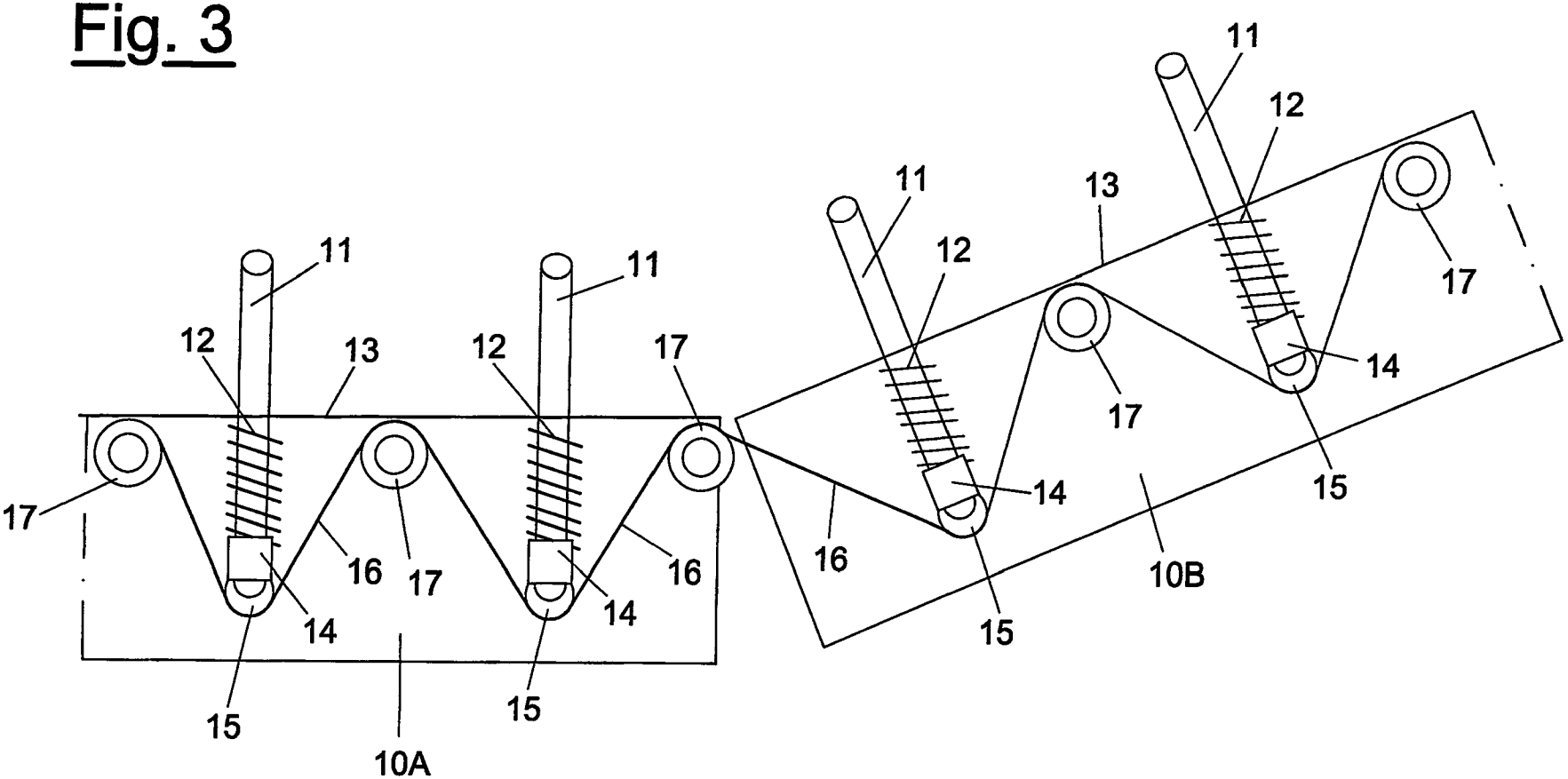
FIG. 3 is a schematic side view of a portion of bed plane with improved structure, according to the present invention, in rest conditions, in which the operation of an articulated part of the plane is illustrated.

FIG. 3 attached to the present description illustrates the same adjustment mechanism, described previously, which is applied to a bed plane with 10 articulated portions 10A, 10B.

From the description that has been made the characteristics of the bed plane with improved structure, object of the present invention, are clear, just as the advantages are also clear.

In particular, they are represented by the following aspects:

"active" support for the spinal column;

suitable comfort for the user;

good transpiration;

substantial lightness of the entire structure;

limited costs, in relation to the advantages obtained.

Finally, it is clear that numerous other variants can be brought to the bed plane with improved structure in question, without for this reason departing from the novelty principles inherent to the inventive idea, just as it is clear that, in the practical embodiment of the invention, the materials, the shapes and the sizes of the illustrated details can be whatever according to requirements and they can be replaced with others that are technically equivalent.

The invention claimed is:

1. Bed plane with improved structure, comprising a plurality of slats, arranged transversally at least one portion of frame (10) of the bed and connected to said bed through slat-holders, and having a series of stems or pistons (11), where each is connected with one or more of said slats and each stem or piston (11) is associated with at least one respective elastic sliding element (12), each stem or piston (11) being fixed to at least one first pulley or sliding guide (15) for the transmission of motion, which occurs due to the interposition of flexible member (16), which is selected from cords, belts, chains and/or cables, that are connected to the frame (10) of the bed plane, so that said stems or pistons (11) react to the pressures exerted by a body lying down on the bed plane, and compensate for the sinking created by the parts of the body between the shoulders and the pelvis, with an upward thrust wherein said elastic sliding element (12) is a spring which surrounds said stems or pistons (11).

2. Bed plane with improved structure according to claim 1, wherein said frame (10) comprises a central bearing body, from which said stems or pistons (11) project and at the top end of which the slats are connected, through balancing joints, said slats being arranged transversally to the plane, which consist the support for the mattress.

3. Bed plane with improved structure according to claim 1, wherein said stems or pistons (11) are connected at the top to a support beam, in turn connected, through balancing joints, to a pair of flexible slats.

4. Bed plane with improved structure according to claim 1, wherein each stem or piston (11) has a vertical excursion, which allows the bed plane to adapt to the anatomy of the body, independently of the weight and configuration of the person lying down on it, so that the lowering of one or more slats or portions thereof corresponds to the raising of other slats of the bed plane.

5. Bed plane with improved structure according to claim 1, wherein said frame (10) is of the perimetric type, in which the slats are contained inside the frame (10) itself, or said frame (10) is constructed in an underlying position and is smaller in size than the slats and in which the slats define the perimeter of the bed plane.

6. Bed plane with improved structure according to claim 1, wherein said bed plane includes further pulleys or sliding guides (17) for the transmission of motion, each of which is fixed to the top end (13) of the frame (10) and is arranged, at a predetermined distance, between one stem (11) and the next stem.

7. Bed plane with improved structure according to claim 1, wherein said stems or pistons (11) are arranged in a central portion of the frame (10) and/or of the bed plane.

8. Bed plane with improved structure according to claim 1, wherein said bed plane has articulated portions (10A, 10B) and a single flexible member on each side.

9. Bed plane with improved structure comprising a plurality of slats, arranged transversally at least one portion of frame (10) of the bed and connected to said bed through slat-holders, and having a series of stems or pistons (11), where each is connected with one or more of said slats and each stem or piston (11) is associated with at least one respective elastic sliding element (12), each stem or piston (11) being fixed to at least one first pulley or sliding guide (15) for the transmission of motion, which occurs due to the interposition of flexible member (16), which is selected from cords, belts, chains and/or cables, that are connected to the frame (10) of the bed plane, so that said stems or pistons (11) react to the pressures exerted by a body lying down on the bed plane, and compensate for the sinking created by the parts of the body between the shoulders and the pelvis, with an upward thrust wherein said elastic sliding element (12) is arranged between the top end (13) of frame (10) and a support block (14) of pulley (15).

10. Bed plane with improved structure according to claim 9, wherein said frame (10) comprises a central bearing body, from which said stems or pistons (11) project and at the top end of which the slats are connected, through balancing joints, said slats being arranged transversally to the plane, which usually consist the support for the mattress.

11. Bed plane with, improved structure according to claim 9, wherein said stems or pistons (11) are connected at the top to a support beam, in turn connected, through balancing joints, to a pair of flexible slats.

12. Bed plane with improved structure according to claim 9, wherein each stem or piston (11) has a vertical excursion, which allows the bed plane to adapt to the anatomy of the body, independently of the weight and configuration of the person lying down on it, so that the lowering of one or more slats or portions thereof corresponds to the raising of other slats of the bed plane.

13. Bed plane with improved structure according to claim 9, wherein said frame (10) is of the perimetric type, in which the slats are contained inside the frame (10) itself, or said frame (10) is constructed in an underlying position and is smaller in size than the slats and in which the slats define the perimeter of the bed plane.

14. Bed plane with improved structure according to claim 9, wherein said bed plane includes further pulleys or sliding guides (17) for the transmission of motion, each of which is fixed to the top end (13) of the frame (10) and is arranged, at a predetermined distance, between one stem (11) and the next stem.

15. Bed plane with improved structure according to claim 9, wherein said stems or pistons (11) are arranged in a central portion of the frame (10) and/or of the bed plane.

16. Bed plane with improved structure according to claim 9, wherein said bed plane has articulated portions (10A, 10B) and a single flexible member on each side.

* * * * *